US010063984B2

(12) United States Patent
Johnson et al.

(10) Patent No.: US 10,063,984 B2
(45) Date of Patent: Aug. 28, 2018

(54) METHOD FOR CREATING A VIRTUAL ACOUSTIC STEREO SYSTEM WITH AN UNDISTORTED ACOUSTIC CENTER

(71) Applicant: Apple Inc., Cupertino, CA (US)

(72) Inventors: Martin E. Johnson, Los Gatos, CA (US); Sylvain J. Choisel, San Francisco, CA (US); Daniel K. Boothe, San Francisco, CA (US); Mitchell R. Lerner, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/514,813

(22) PCT Filed: Sep. 29, 2015

(86) PCT No.: PCT/US2015/053023
§ 371 (c)(1),
(2) Date: Mar. 27, 2017

(87) PCT Pub. No.: WO2016/054098
PCT Pub. Date: Apr. 7, 2016

(65) Prior Publication Data

US 2017/0230772 A1 Aug. 10, 2017

Related U.S. Application Data

(60) Provisional application No. 62/057,995, filed on Sep. 30, 2014.

(51) Int. Cl.
*H04R 5/00* (2006.01)
*H04S 1/00* (2006.01)
*H04S 7/00* (2006.01)

(52) U.S. Cl.
CPC ..... *H04S 1/002* (2013.01); *H04S 7/307* (2013.01); *H04S 2400/09* (2013.01);
(Continued)

(58) Field of Classification Search
CPC .. H04S 2400/09; H04S 7/307; H04S 2400/11; H04S 2420/01; H04S 2400/13
(Continued)

(56) References Cited

U.S. PATENT DOCUMENTS 6,668,061 B1 * 12/2003 Abel ..... H04S 1/002 381/1
6,700,980 B1 * 3/2004 Hamalainen ..... H04S 1/002 381/1
(Continued)

FOREIGN PATENT DOCUMENTS

WO WO 87/06090 A1 10/1987
WO WO2007/004147 A2 1/2007

OTHER PUBLICATIONS

PCT International Search Report and Written Opinion for PCT International Appln No. PCT/US2015/053023 dated Dec. 4, 2015 (12 pages).
(Continued)

*Primary Examiner* — Disler Paul
(74) *Attorney, Agent, or Firm* — Womble Bond Dickinson (US) LLP

(57) ABSTRACT

A system and method are described for transforming stereo signals into mid and side components xm and xs to apply processing to only the side-component xs and avoid processing the mid-component. By avoiding alteration to the mid-component $x_M$, the system and method may reduce the effects of ill-conditioning, such as coloration that may be caused by processing a problematic mid-component xM while still performing crosstalk cancellation and/or generating virtual sound sources. Additional processing may be separately applied to the mid and side components $x_M$ and xs and/or particular frequency bands of the original stereo signals to further reduce ill-conditioning.

22 Claims, 11 Drawing Sheets

(52) U.S. Cl.
CPC ..... *H04S 2400/11* (2013.01); *H04S 2400/13* (2013.01); *H04S 2420/01* (2013.01)

(58) Field of Classification Search
USPC ..... 381/17, 303, 18, 309–310
See application file for complete search history.

(56) References Cited

U.S. PATENT DOCUMENTS

| | | | | |
|---|---|---|---|---|
| 8,391,498 | B2 * | 3/2013 | Potard | H04S 1/002 381/1 |
| 8,619,998 | B2 * | 12/2013 | Walsh | H04S 3/02 381/1 |
| 2005/0265558 | A1 * | 12/2005 | Neoran | H04S 1/002 381/17 |
| 2007/0274552 | A1 * | 11/2007 | Konchitsky | H04R 3/007 381/328 |
| 2008/0031462 | A1 | 2/2008 | Walsh et al. | |
| 2010/0027799 | A1 | 2/2010 | Romesburg et al. | |
| 2014/0270185 | A1 * | 9/2014 | Walsh | H04S 5/00 381/17 |
| 2014/0270281 | A1 * | 9/2014 | Walsh | H04S 3/02 381/300 |

OTHER PUBLICATIONS

PCT International Preliminary Report on Patentability for PCT/US2015/053023, dated Apr. 13, 2017.

* cited by examiner

METHOD FOR CREATING A VIRTUAL ACOUSTIC STEREO SYSTEM WITH AN UNDISTORTED ACOUSTIC CENTER

This application is a U.S. National Phase Application under 35 U.S.C. § 371 of International Application No. PCT/US2015/053023, filed Sep. 29, 2015, which claims the benefit of U.S. Provisional Patent Application No. 62/057,995, filed Sep. 30, 2014, and this application hereby incorporates herein by reference that provisional patent application.

FIELD

A system and method for generating a virtual acoustic stereo system by converting a set of left-right stereo signals to a set of mid-side stereo signals and processing only the side-components is described. Other embodiments are also described.

BACKGROUND

A single loudspeaker may create sound at both ears of a listener. For example, a loudspeaker on the left side of a listener will still generate some sound at the right ear of the listener along with sound, as intended, at the left ear of the listener. The objective of a crosstalk canceler is to allow production of sound from a corresponding loudspeaker at one of the listener's ears without generating sound at the other ear. This isolation allows any arbitrary sound to be generated at one ear without bleeding to the other ear. Controlling sound at each ear independently can be used to create the impression that the sound is coming from a location away from the physical loudspeaker (i.e., a virtual loudspeaker/sound source).

In principle, a crosstalk canceler requires only two loudspeakers (i.e., two degrees of freedom) to control the sound at two ears separately. Many crosstalk cancelers control sound at the ears of a listener by compensating for effects generated by sound diffracting around the listener's head, commonly known as Head Related Transfer Functions (HRTFs). Given a right audio input channel $x_R$ and a left audio input channel $x_L$, the crosstalk canceler may be represented as:

$$\begin{bmatrix} y_L \\ y_R \end{bmatrix} = [H][W]\begin{bmatrix} x_R \\ x_L \end{bmatrix}$$

In this equation, the transfer function H of the listener's head due to sound coming from the loudspeakers is compensated for by the matrix W. Ideally, the matrix W is the inverse of the transfer function H (i.e., $W=H^{-1}$). In this ideal situation in which W is the inverse of H, sound $y_L$ heard at the left ear of the listener is identical to $x_L$ and sound $y_R$ heard at the right ear of the listener is identical to $x_R$. However, many crosstalk cancelers suffer from ill-conditioning at some frequencies. For example, the loudspeakers in these systems may need to be driven with large signals (i.e., large values in the matrix W) to achieve crosstalk cancellation and are very sensitive to changes from ideal. In other words, if the system is designed using an assumed transfer function H representing propagation of sound from the loudspeakers to the listener's ears, small changes in H can cause the crosstalk canceler to achieve a poor listening experience for the listener.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

A system and method is disclosed for performing crosstalk cancellation and generating virtual sound sources in a listening area based on left and right stereo signals $x_L$ and $x_R$. In one embodiment, the left and right stereo signals $x_L$ and $x_R$ are transformed to mid and side component signals $x_M$ and $x_S$. In contrast to the signals $x_L$ and $x_R$ that represented separate left and right components for a piece of sound program content, the mid-component $x_M$ represents the combined left-right stereo signals $x_L$ and $x_R$ while the mid-component $x_M$ represents the difference between these left-right stereo signals $x_L$ and $x_R$.

Following the conversion of the left-right stereo signals $x_L$ and $x_R$ to the mid-side components $x_M$ and $x_S$, a set of filters may be applied to the mid-side components $x_M$ and $x_S$. The set of filters may be selected to 1) perform crosstalk cancellation based on the positioning and characteristics of a listener, 2) generate the virtual sound sources in the listening area, and 3) provide transformation back to left-right stereo. In one embodiment, processing by these filters may only be performed on the side-component signal $x_S$ and avoid processing the mid-component $x_M$. By avoiding alteration to the mid-component $x_M$, the system and method described herein may eliminate or greatly reduce problems caused by ill-conditioning such as coloration, excessive drive signals and sensitivity to changes in the audio system. In some embodiments, separate equalization and processing may be performed on the mid-side components $x_M$ and $x_S$ to further reduce the effects of ill-conditioning such as coloration.

In some embodiments, the original signals $x_L$ and $x_R$ may be separated into separate frequency bands. In this embodiment, processing by the above described filters may be limited to a particular frequency band. For example, low and high components of the original signals $x_L$ and $x_R$ may not be processed while a frequency band between associated low and high cutoff frequencies may be processed. By sequestering low and high components of the original signals $x_L$ and $x_R$, the system and method for processing described herein may reduce the effects of ill-conditioning such as coloration that may be caused by processing problematic frequency bands.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
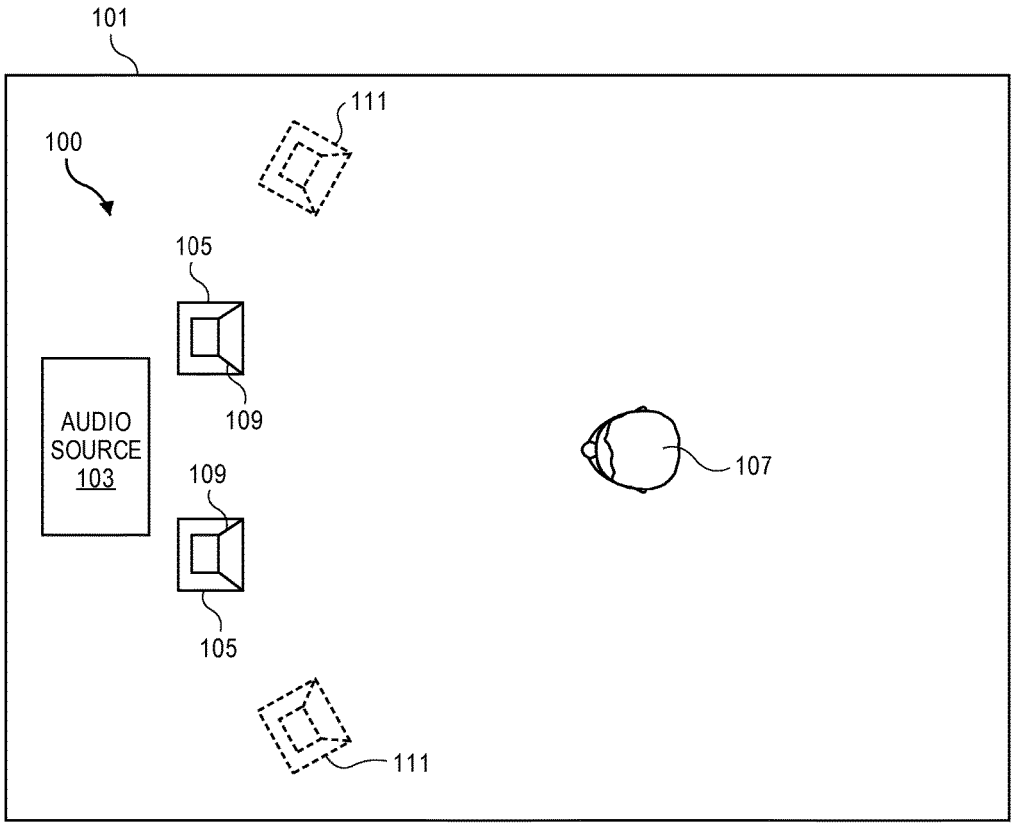
FIG. 1 shows a view of an audio system within a listening area according to one embodiment.

FIG. 1 shows a view of an audio system 100 within a listening area 101. The audio system 100 may include an audio source 103 and a set of loudspeakers 105. The audio source 103 may be coupled to the loudspeakers 105 to drive individual transducers 109 in the loudspeakers 105 to emit various sounds for a listener 107 using a set of amplifiers, drivers, and/or signal processors. In one embodiment, the loudspeakers 105 may be driven to generate sound that represents individual channels for one or more pieces of sound program content. Playback of these pieces of sound program content may be aimed at the listener 107 within the listening area 101 using virtual sound sources 111. In one embodiment, the audio source 103 may perform crosstalk cancellation on one or more components of input signals prior to generating virtual sound sources as will be described in greater detail below.

As shown in FIG. 1, the listening area 101 is a room or another enclosed space. For example, the listening area 101 may be a room in a house, a theatre, etc. Although shown as an enclosed space, in other embodiments, the listening area 101 may be an outdoor area or location, including an outdoor arena. In each embodiment, the loudspeakers 105 may be placed in the listening area 101 to produce sound that will be perceived by the listener 107. As will be described in greater detail below, the sound from the loudspeakers 105 may either appear to emanate from the loudspeakers 105 themselves or through the virtual sound sources 111. The virtual sound sources 111 are areas within the listening area 101 in which sound is desired to appear to emanate from. The position of these virtual sound sources 111 may be defined by any technique, including an indication from the listener 107 or an automatic configuration based on the orientation and/or characteristics of the listening area 101.

Figure 2:
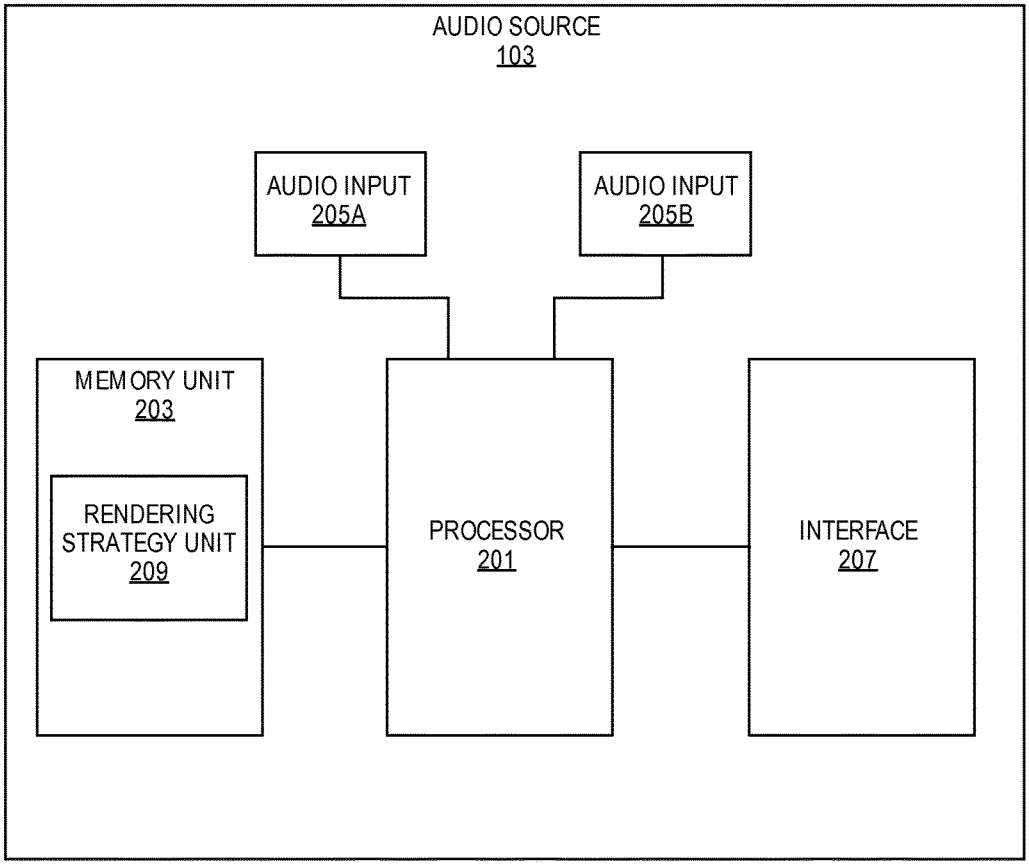
FIG. 2 shows a component diagram of an example audio source according to one embodiment.

FIG. 2 shows a component diagram of an example audio source 103 according to one embodiment. The audio source 103 may be any electronic device that is capable of transmitting audio content to the loudspeakers 105 such that the loudspeakers 105 may output sound into the listening area 101. For example, the audio source 103 may be a desktop computer, a laptop computer, a tablet computer, a home theater receiver, a television, a set-top box, a personal video player, a DVD player, a Blu-ray player, a gaming system, and/or a mobile device (e.g., a smartphone).

As shown in FIG. 2, the audio source 103 may include a hardware processor 201 and/or a memory unit 203. The processor 201 and the memory unit 203 are generically used here to refer to any suitable combination of programmable data processing components and data storage that conduct the operations needed to implement the various functions and operations of the audio source 103. The processor 201 may be an applications processor typically found in a smart phone, while the memory unit 203 may refer to microelectronic, non-volatile random access memory. An operating system may be stored in the memory unit 203 along with application programs specific to the various functions of the audio source 103, which are to be run or executed by the processor 201 to perform the various functions of the audio source 103. For example, a rendering strategy unit 209 may be stored in the memory unit 203. As will be described in greater detail below, the rendering strategy unit 209 may be used to crosstalk cancel a set of audio signals and generate a set of signals to represent the virtual acoustic sound sources 111.

Although the rendering strategy unit 209 is shown and described as a segment of software stored within the memory unit 203, in other embodiments the rendering strategy unit 209 may be implemented in hardware. For example, the rendering strategy unit 209 may be composed of a set of hardware circuitry, including filters (e.g., finite impulse response (FIR) filters) and processing units, that are used to implement the various operations and attributes described herein in relation to the rendering strategy unit 209.

In one embodiment, the audio source 103 may include one or more audio inputs 205 for receiving audio signals from external and/or remote devices. For example, the audio source 103 may receive audio signals from a streaming media service and/or a remote server. The audio signals may represent one or more channels of a piece of sound program content (e.g., a musical composition or an audio track for a movie). For example, a single signal corresponding to a single channel of a piece of multichannel sound program content may be received by an input 205 of the audio source 103. In another example, a single signal may correspond to multiple channels of a piece of sound program content, which are multiplexed onto the single signal.

In one embodiment, the audio source 103 may include a digital audio input 205A that receives digital audio signals from an external device and/or a remote device. For example, the audio input 205A may be a TOSLINK connector or a digital wireless interface (e.g., a wireless local area network (WLAN) adapter or a Bluetooth receiver). In one embodiment, the audio source 103 may include an analog audio input 205B that receives analog audio signals from an external device. For example, the audio input 205B may be a binding post, a Fahnestock clip, or a phono plug that is designed to receive and/or utilize a wire or conduit and a corresponding analog signal from an external device.

Although described as receiving pieces of sound program content from an external or remote source, in some embodiments pieces of sound program content may be stored locally on the audio source 103. For example, one or more pieces of sound program content may be stored within the memory unit 203.

In one embodiment, the audio source 103 may include an interface 207 for communicating with the loudspeakers 105 and/or other devices (e.g., remote audio/video streaming services). The interface 207 may utilize wired mediums (e.g., conduit or wire) to communicate with the loudspeakers 105. In another embodiment, the interface 207 may communicate with the loudspeakers 105 through a wireless connection as shown in FIG. 1. For example, the network interface 207 may utilize one or more wireless protocols and standards for communicating with the loudspeakers 105, including the IEEE 802.11 suite of standards, cellular Global System for Mobile Communications (GSM) standards, cellular Code Division Multiple Access (CDMA) standards, Long Term Evolution (LTE) standards, and/or Bluetooth standards.

As described above, the loudspeakers 105 may be any device that includes at least one transducer 109 to produce sound in response to signals received from the audio source 103. For example, the loudspeakers 105 may each include a single transducer 109 to produce sound in the listening area 101. However, in other embodiments, the loudspeakers 105 may be loudspeaker arrays that include two or more transducers 109.

The transducers 109 may be any combination of full-range drivers, mid-range drivers, subwoofers, woofers, and tweeters. Each of the transducers 109 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 109 magnetic system interact, generating a mechanical force that causes the coil (and thus, the attached cone) to move back and forth, thereby reproducing sound under the control of the applied electrical audio signal coming from an audio source, such as the audio source 103. Although electromagnetic dynamic loudspeaker drivers are described for use as the transducers 109, those skilled in the art will recognize that other types of loudspeaker drivers, such as piezoelectric, planar electromagnetic and electrostatic drivers are possible.

Each transducer 109 may be individually and separately driven to produce sound in response to separate and discrete audio signals received from an audio source 103. By allowing the transducers 109 in the loudspeakers 105 to be individually and separately driven according to different parameters and settings (including delays and energy levels), the loudspeakers 105 may produce numerous separate sounds that represent each channel of a piece of sound program content output by the audio source 103.

Although shown in FIG. 1 as including two loudspeakers 105, in other embodiments a different number of loudspeakers 105 may be used in the audio system 100. Further, although described as similar or identical styles of loudspeakers 105, in some embodiments the loudspeakers 105 in the audio system 100 may have different sizes, different shapes, different numbers of transducers 109, and/or different manufacturers.

Although described and shown as being separate from the audio source 103, in some embodiments, one or more components of the audio source 103 may be integrated within the loudspeakers 105. For example, one or more of the loudspeakers 105 may include the hardware processor 201, the memory unit 203, and the one or more audio inputs 205. In this example, a single loudspeaker 105 may be designated as a master loudspeaker 105. This master loudspeaker 105 may distribute sound program content and/or control signals (e.g., data describing beam pattern types) to each of the other loudspeakers 105 in the audio system 100.

Figure 3:
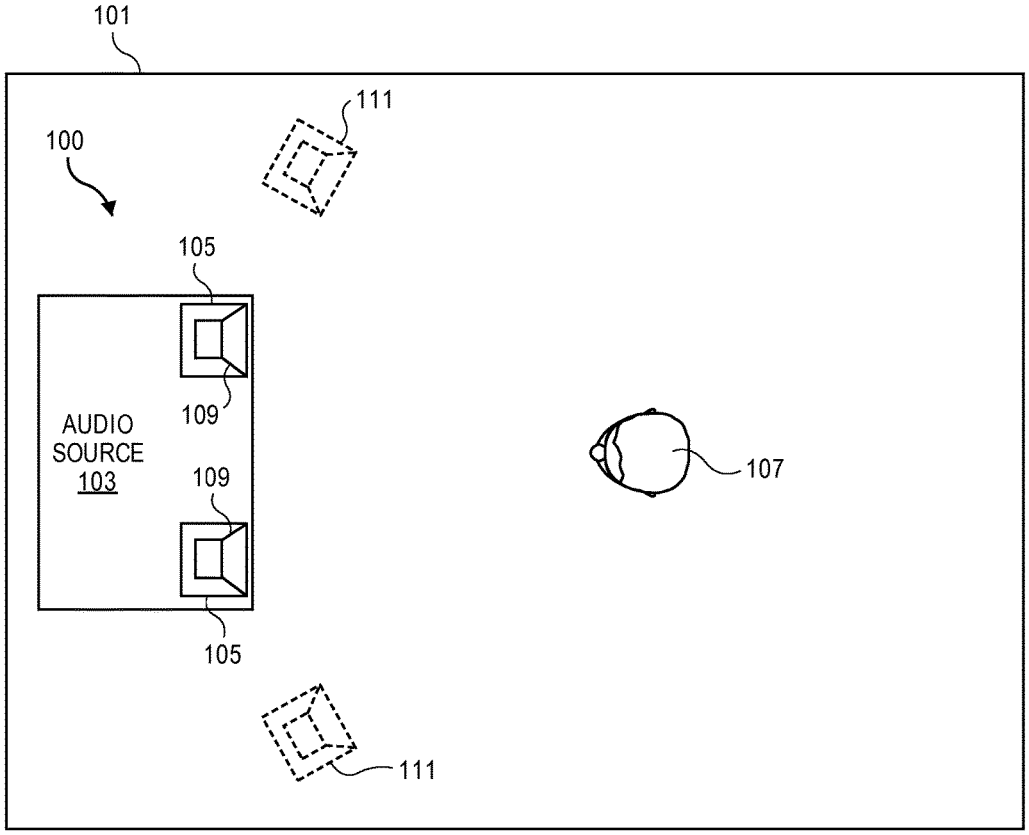
FIG. 3 shows an audio source with a set of loudspeakers located close together within a compact audio source according to one embodiment.

As noted above, the rendering strategy unit 209 may be used to crosstalk cancel a set of audio signals and generate a set of virtual acoustic sound sources 111 based on this crosstalk cancellation. The objective of the virtual acoustic sound sources 111 is to create the illusion that sound is emanating from a direction which there is no real sound source (e.g., a loudspeaker 105). One example application might be stereo widening where two closely spaced loudspeakers 105 are too close together to give a good stereo rendering of sound program content (e.g., music or movies). For example, two loudspeakers 105 may be located within a compact audio source 103 such as a telephone or tablet computing device as shown in FIG. 3. In this scenario, the rendering strategy unit 209 may attempt to make the sound emanating from these fixed integrated loudspeakers 105 to appear to come from a sound stage that is wider than the actual separation between the left and right loudspeakers 105. In particular, the sound delivered from the loudspeakers 105 may appear to emanate from the virtual sound sources 111, which are placed wider than the loudspeakers 105 integrated and fixed within the audio source 103.

Figure 4:
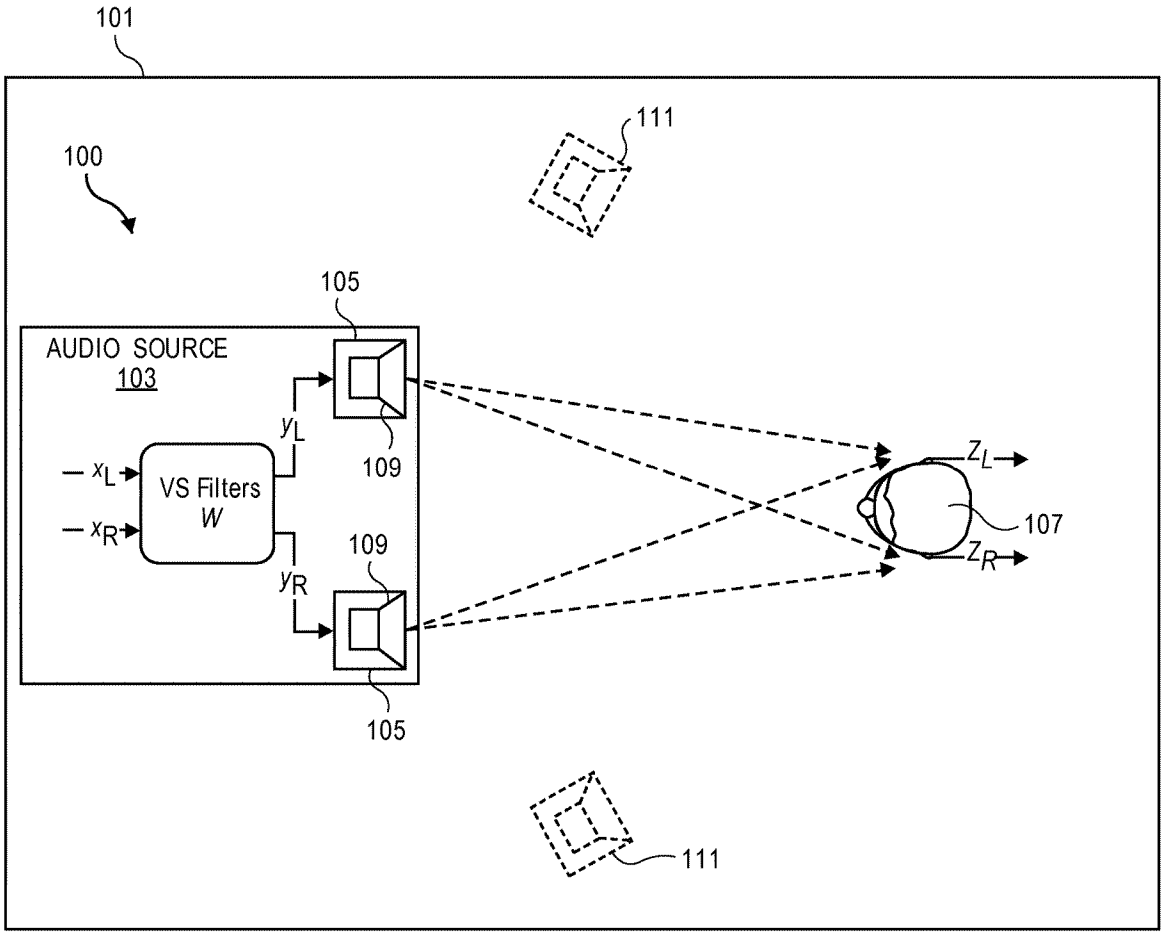
FIG. 4 shows the interaction of sound from a set of loudspeakers at the ears of a listener according to one embodiment.

In one embodiment, crosstalk cancellation may be used for generating the virtual sound sources 111. In this embodiment, a two-by-two matrix H of loudspeakers 105 to ears of the listener 107 describing the transfer functions may be inverted to allow independent control of sound at the right and left ears of the listener 107 as shown in FIG. 4. However, this technique may suffer from a number of issues, including (i) coloration issues (e.g., changes in equalization) (ii) mismatches between the listener's 107 head related transfer functions (HRTFs) and the HRTFs assumed by the rendering strategy unit 209, and (iii) ill-conditioning of the inverse of the HRTFs (e.g., inverse of H), which leads to the loudspeakers 105 being overdriven.

Figure 5A:
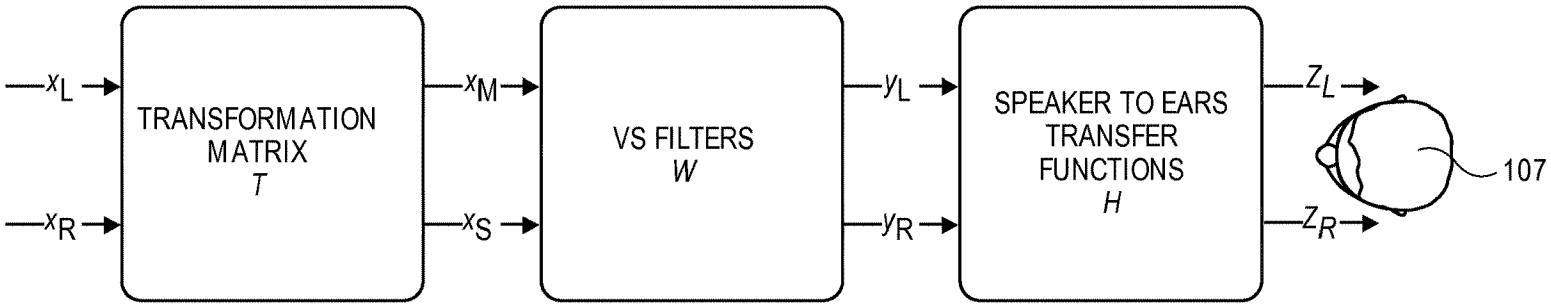
FIG. 5A shows a signal flow diagram for performing crosstalk cancellation and generating virtual sound sources according to one embodiment.

To address the issues related to coloration and ill-conditioning, such as coloration, in one embodiment the rendering strategy unit 209 may transform the problem from left-right stereo to mid-side stereo. In particular, FIG. 5A shows a signal flow diagram according to one embodiment for a set of signals $x_L$ and $x_R$. The signals $x_L$ and $x_R$ may represent left and right channels for a piece of sound program content. For example, the signals $x_L$ and $x_R$ may represent left and right stereo channels for a musical composition. However, in other embodiments, the stereo signals $x_L$ and $x_R$ may correspond to any other sound recording, including an audio track for a movie or a television program.

As described above, the signals $x_L$ and $x_R$ represent left-right stereo channels for a piece of sound program content. In this context, the signal $x_L$ characterizes sound in the left aural field represented by the piece of sound program content and the signal $x_R$ characterizes sound in the right aural field represented by the piece of sound program content. The signals $x_L$ and $x_R$ are synchronized such that playback of these signals through the loudspeaker 105 would create the illusion of directionality and audible perspective.

In a typical set of left-right stereo signals $x_L$ and $x_R$, an instrument or vocal can be panned from left to right to generate what may be termed as the sound stage. Many times, but not necessarily always, the main focus of the piece of sound program content being played is panned down the middle (i.e., $x_L=x_R$). The most important example would be vocals (e.g., main vocals for a musical composition instead of background vocals or reverberation/effects, which are panned left or right). Also, low frequency instruments, such as bass and kick drums are typically panned down the middle. Accordingly, in the bass region, where it is important to maintain output levels (especially for small loudspeaker systems, such as those in consumer products), it may be important to reduce the effects of ill-conditioning, such as coloration. Further, for centrally panned vocals, it is important not to add coloration to the signals used to drive the loudspeakers 105. Coloration may also vary from listener-to-listener. Thus, it may be difficult to equalize out these coloration effects. Given these issues, the rendering strategy unit 209 may keep the centrally panned or mid-components untouched while making adjustments to side-components.

To allow for this independent handling/adjustment of mid-components and side-components, in one embodiment, the signals $x_L$ and $x_R$ may be transformed from left-right stereo to mid-side stereo using a mid-side transformation matrix T as shown in FIG. 5A. In this embodiment, the mid-side transformation of the signals $x_L$ and $x_R$ may be represented by the signals $x_M$ and $x_S$ as shown in FIG. 5A, where $x_M$ represents the mid-component and $x_S$ represents the side-component of the left-right stereo signals $x_L$ and $x_R$. In one embodiment, the mid-component $x_M$ may be generated based on the following equation:

$$x_M=x_L+x_R$$

Similar to the value of the mid-component $x_M$ shown above, in one embodiment, the side-component $x_S$ may be generated based on the following equation:

$$x_S=x_L-x_R$$

Accordingly, in contrast to the signals $x_L$ and $x_R$ that represented separate left and right components for a piece of sound program content, the mid-component $x_M$ represents the combined left-right stereo signals $x_L$ and $x_R$ (i.e., a center channel) while the mid-component $x_M$ represents the difference between these left-right stereo signals $x_L$ and $x_R$. In these embodiments, the transformation matrix T may be calculated to generate the mid-component $x_M$ and the side-component $x_S$ according to the above equations. The transformation matrix T may be composed of real numbers and independent of frequency. Thus, the transformation matrix T may be applied using multiplication instead use of a filter. For example, in one embodiment the transformation matrix T may include the values shown below:

$$T=\begin{bmatrix}0.5000 & 0.5000\\ 0.5000 & -0.5000\end{bmatrix}$$

In other embodiments, different values for the transformation matrix T may be used such that the mid-component $x_M$ and the side-component $x_S$ are generated/isolated according to the above equations. Accordingly, the values for the transformation matrix T are provided by way of example and are not limiting on the possible values of the matrix T.

Figure 5B:
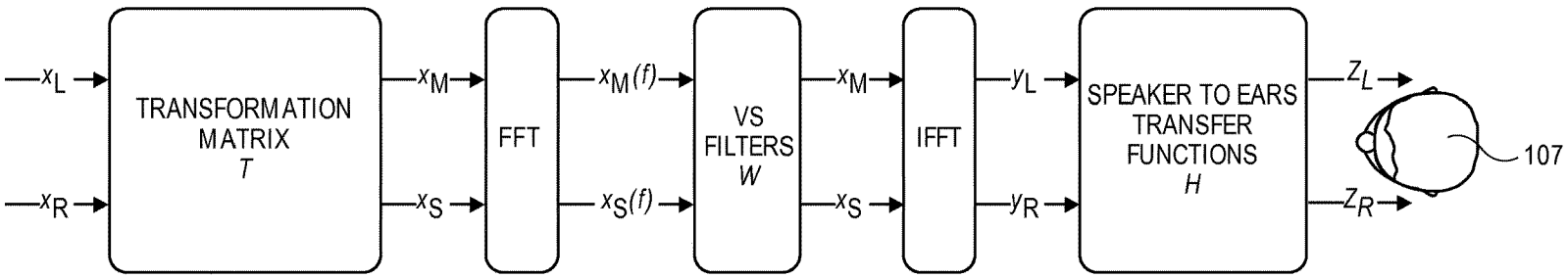
FIG. 5B shows a signal flow diagram for performing crosstalk cancellation and generating virtual sound sources in the frequency domain according to one embodiment.

Following the conversion of the left-right stereo signals $x_L$ and $x_R$ to the mid-side components $x_M$ and $x_S$, a set of filters may be applied to the mid-side components $x_M$ and $x_S$. The set of filters may be represented by the matrix W shown in FIG. 5A. In one embodiment, the matrix W may be generated and/or the values in the matrix W may be selected to 1) perform crosstalk cancellation based on the positioning and characteristics of the listener 107, 2) generate the virtual sound sources 111 in the listening area 101, and 3) provide transformation back to left-right stereo. These formulations may be performed in the frequency domain as shown in FIG. 5B such that the two-by-two matrix W is at a single frequency and will be different in each frequency band. The calculation is done frequency-by-frequency in order to build up filters. Once this filter buildup is done the filters can be implemented in the time domain (e.g., using Finite Impulse Response (FIR) or Infinite Impulse Response (IIR) filters) or in the frequency domain.

In one embodiment, the matrix W may be represented by the values shown below, wherein i represents the imaginary number in the complex domain:

$$W=\begin{bmatrix}0.7167-0.0225i & 2.7567-0.3855i\\ 0.7167-0.0225i & 2.7567+0.3855i\end{bmatrix}$$

In the example matrix W shown above, values in the leftmost column of the matrix W represent filters that would be applied to the mid-component $x_M$ while the values in the rightmost column of the matrix W represent filters that would be applied to the side-component $x_S$. As noted above, these filter values in the matrix W 1) perform crosstalk cancellation such that sound originating from the left loudspeaker 105 is not heard/picked-up by the right ear of the listener 107 and sound originating from the right loudspeaker 105 is not heard/picked-up by the left ear of the listener 107, 2) generate the virtual sound sources 111 in the listening area 101, and 3) provide transformation back to left-right stereo. Accordingly, the signals $y_L$ and $y_R$ represent left-right stereo signals after the filters represented by the matrix W have been applied to the mid-side stereo signals $x_M$ and $x_S$.

As shown in FIG. 5A and described above, the left-right stereo signals $y_L$ and $y_R$ may be played through the loudspeakers 105. Propagating through the distance between the loudspeakers 105 and the ears of the listener 107, the signals $y_L$ and $y_R$ may be modified according to the transfer function represented by the matrix H. This transformation results in the left-right stereo signals $z_L$ and $z_R$, which represent sound respectively heard at the left and right ears of the listener 107. The desired signal d at the ears of the listener 107 is defined by the HRTFs for the desired angles of the virtual sound sources 111 represented by the matrix D. Accordingly, the left-right stereo signals $z_L$ and $z_R$ and the desired signal d, which are heard at the location of the listener 107, may be represented as follows:

$$z_{LR}=d=Dx_{LR}=HWTx_{LR}$$

In the above representation of the left-right stereo signals $z_L$ and $z_R$ and the desired signal d, the matrix W may be represented according to the equation below:

$$W=H^{-1}DT^{-1}$$

Accordingly, the matrix W 1) accounts for the effects of sound propagating from the loudspeakers 105 to the ears of the listener 107 through the inversion of the loudspeaker-to-ear transfer function H (i.e., $H^{-1}$), 2) adjusts the mid-side stereo signals $x_M$ and $x_S$ to represent the virtual sound sources 111 represented by the matrix D, and 3) transforms the mid-side stereo signals $x_M$ and $x_S$ back to left-right stereo domain through the inversion of the transformation matrix T (i.e., $T^{-1}$).

As described above, the mid-component of audio is especially susceptible to ill-conditioning and general poor results when crosstalk cancellation is applied. To avoid or mitigate these effects, in one embodiment, the matrix W may be normalized to avoid alteration of the mid-component signal $x_M$. For example, the values in the matrix W corresponding to the mid-component signal $x_M$ may be set to a value of one (1.0) such that the mid-component signal $x_M$ is not altered when the matrix W is applied as described and shown above. In one embodiment, the normalized matrix $W_{norm1}$ may be generated by dividing each value in the matrix W by the value of the values in the matrix W corresponding to the mid-component signal $x_M$. As noted above, the values in the leftmost column of the matrix W represent filters that would be applied to the mid-component $x_M$ while the values in the rightmost column of the matrix W represent filters that would be applied to the side-component $x_S$. In one embodiment, this normalized matrix $W_{norm1}$ may be generated according to the equation below:

$$W_{norm1}=\frac{W}{W_{11}}$$

In the above equation, $W_{12}$ represents the top-left value of the matrix W as shown below:

$$W=\begin{bmatrix} W_{11} & W_{21} \\ W_{12} & W_{22} \end{bmatrix} \quad W=\begin{bmatrix} 0.7167-0.0225i & 2.7567-0.3855i \\ 0.7167-0.0225i & 2.7567+0.3855i \end{bmatrix}$$

Accordingly, the normalized matrix $W_{norm1}$ may be computed as shown below:

$$W_{norm1}=\begin{bmatrix} \frac{0.7167-0.0225i}{0.7167-0.0225i} & \frac{2.7567-0.3855i}{0.7167-0.0225i} \\ \frac{0.7167-0.0225i}{0.7167-0.0225i} & \frac{2.7567+0.3855i}{0.7167-0.0225i} \end{bmatrix}$$

$$W_{norm1}=\begin{bmatrix} 1.0000 & 3.8594-0.4169i \\ 1.0000 & 3.8594+0.4169i \end{bmatrix}$$

Accordingly, by altering the mid-components of the matrix W (i.e., the leftmost column of the matrix W) such that these value are equal to 1.0000, the normalized matrix $W_{norm1}$ guarantees that the mid-component signal $x_M$ passes through without being altered by the matrix $W_{norm1}$. By allowing the mid-component signal $x_M$ to remain unchanged and unaffected by the effects of crosstalk cancellation and other alterations caused by application of the matrices W and $W_{norm1}$, ill-conditioning and other undesirable effects, which would be most noticeable in the mid-component signal $x_M$ as described above, may be reduced.

In one embodiment, the normalized matrix $W_{norm1}$ may be compressed to generate the normalized matrix $W_{norm2}$. In particular, in one embodiment, the normalized matrix $W_{norm1}$ may be compressed such that the values corresponding to the side-component signal $x_S$ avoid becoming too large and consequently may reduce ill-conditioned effects, such as coloration effects. For example, the normalized matrix $W_{norm2}$ may be represented by the values shown below, wherein $\alpha$ is less than one, may be frequency dependent, and represents an attenuation factor used to reduce excessively larger terms:

$$W_{norm2}=\begin{bmatrix} 1.0000 & \alpha(3.8594-0.4169i) \\ 1.0000 & \alpha(3.8594+0.4169i) \end{bmatrix}$$

By compressing the values in the normalized matrix $W_{norm1}$ to form the normalized matrix $W_{norm2}$, ill-conditioning issues (e.g., coloration) that result in the loudspeakers 105 being driven hard and/or over-sensitivity related to assumptions regarding the HRTFs corresponding to the listener 107 may be reduced.

As described above and shown in FIG. 5A, the left-right stereo signals $x_L$ and $x_R$ may be processed such that the mid-components are unaltered, but side-components are crosstalk cancelled and adjusted to produce the virtual sound sources 111. In particular, by converting the left-right stereo signals $x_L$ and $x_R$ to mid-side stereo signals $x_M$ and $x_S$ and normalizing the matrix W (e.g., applying either the matrix $W_{norm1}$ or $W_{norm2}$) such that the mid-component signal $x_M$ is not processed, the system described above reduces effects created by ill-conditioning (e.g., coloration) while still accurately producing the virtual sound sources 111.

Figure 6:
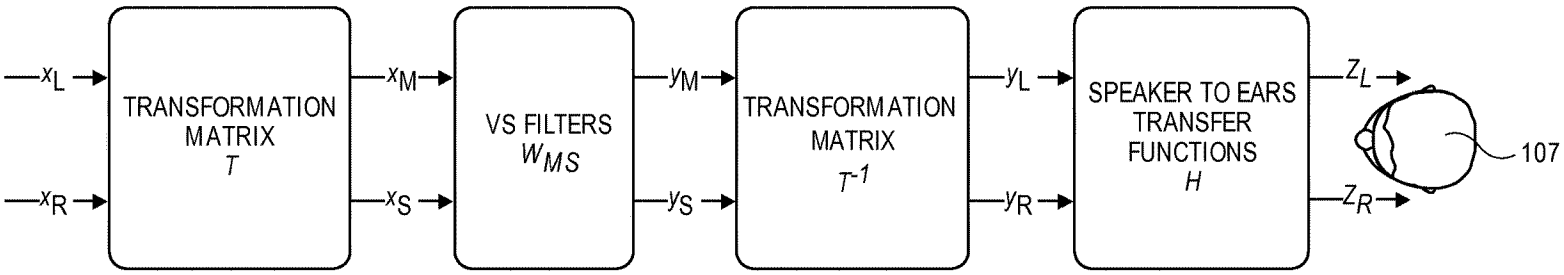
FIG. 6 shows a signal flow diagram for performing crosstalk cancellation and generating virtual sound sources according to another embodiment where the filter blocks are separated out.

Although described above and shown in FIG. 5A as a unified matrix W that accounts for 1) the transfer function H representing the changes caused by the propagation of sound/signals from the loudspeakers 105 to the ears of the listener 107, 2) the transformation of the mid-side stereo signals $x_M$ and $x_S$ to the left-right stereo signals $y_L$ and $y_R$ (i.e., inversion of the transformation matrix T), and 3) adjustment by the matrix D to produce the virtual sound sources 111, FIG. 6 shows that these components may be represented by individual blocks/processing operations.

In particular, as shown in FIG. 6, the original left-right stereo signals $x_L$ and $x_R$ may be transformed by the transformation matrix T. This transformation and the arrangement and values of the transformation matrix T may be similar to the description provided above in relation to FIG. 5A. Accordingly, the transformation matrix T converts the left-right stereo signals $x_L$ and $x_R$ to mid-side stereo signals $x_M$ and $x_S$, respectively, as shown in FIG. 6.

Following transformation by the matrix T, the matrix $W_{MS}$ may process the mid-side stereo signals $x_M$ and $x_S$. In this embodiment, the desired signal d at the ears of the listener 107 may be defined by the HRTFs H for the desired angles of the virtual sound sources 111 represented by the matrix D. Accordingly, the left-right stereo signals $z_L$ and $z_R$ and the desired signal d detected at the ears of the listener 107 may be represented by the following equation:

$$z_{LR}=d=Dx_{LR}=HT^{-1}W_{MS}Tx_{LR}$$

In the above representation of the left-right stereo signals $z_L$ and $z_R$ and the desired signal d, the matrix $W_{MS}$ may be represented by the equation shown below:

$$W_{MS}=TH^{-1}DT^{-1}$$

As noted above, the virtual sound sources 111 may be defined by the values in the matrix D. If D is symmetric (i.e., the virtual sound sources 111 are symmetrically placed and/or widened in relation to the loudspeakers 105) and H is symmetric (i.e., the loudspeakers 105 are symmetrically placed), then the matrix $W_{MS}$ may be a diagonal matrix (i.e., the values outside a main diagonal line within the matrix $W_{MS}$ are zero). For example, in one embodiment, the matrix $W_{MS}$ may be represented by the values shown in the diagonal matrix below:

$$W_{MS}=\begin{bmatrix} 0.7167-0.0225i & 0.0000 \\ 0.0000 & 2.7567+0.3855i \end{bmatrix}$$

In the example matrix $W_{MS}$ shown above, the top left value may be applied to the mid-component signal $x_M$ while the bottom right value may be applied to the side-component signal $x_S$. In some embodiments, separate $W_{MS}$ matrices may be used for separate frequencies or frequency bands of the mid-side signals $x_M$ and $x_S$. For example, 512 separate $W_{MS}$ matrices may be used for separate frequencies or frequency bands represented by the mid-side stereo signals $x_M$ and $x_S$.

Similar to the signal processing shown and described in relation to FIG. 5A, the matrix $W_{MS}$ may be normalized to eliminate application or change to the mid-component, signal $x_M$. As described above, the mid-component of audio is especially susceptible to ill-conditioning and general poor results when crosstalk cancellation is applied. To avoid or mitigate these effects, the values in the matrix $W_{MS}$ corresponding to the mid-component signal $x_M$ may be set to a value of one such that the mid-component signal $x_M$ is not altered when the matrix $W_{MS}$ is applied as described above. In one embodiment, the normalized matrix $W_{MS_norm1}$ may be generated by dividing each value in the matrix $W_{MS}$ by the value in the matrix $W_{MS}$ corresponding to the mid-component signal $x_M$. Accordingly, in one embodiment, this normalized matrix $W_{MS_norm1}$ may be generated according to the equation below:

$$W_{MS_norm1}=\frac{W_{MS}}{W_{MS_11}}$$

In the above equation, $W_{MS_11}$ represents the top-left value of the matrix $W_{MS}$ as shown below:

$$W_{MS}=\begin{bmatrix} W_{MS_11} & W_{MS_21} \\ W_{MS_12} & W_{MS_22} \end{bmatrix}$$

As noted above, in one embodiment, the matrix $W_{MS}$ may be a diagonal matrix (i.e., the values outside a main diagonal line within the matrix $W_{MS}$ are zero). In this embodiment, since the matrix $W_{MS}$ is a diagonal matrix, the computation of values for the matrix $W_{MS_norm1}$ may be performed on only the main diagonal of the matrix $W_{MS}$ (i.e., the non-zero values in the matrix $W_{MS}$). Accordingly, the normalized matrix $W_{MS_norm1}$ may be computed as shown in the examples below:

$$W_{MS_norm1}=\begin{bmatrix} \frac{0.7167-0.0225i}{0.7167-0.0225i} & 0.0000 \\ 0.0000 & \frac{2.7567+0.3855i}{0.7167-0.0225i} \end{bmatrix}$$

$$W_{MS_norm1}=\begin{bmatrix} 1.0000 & 0.0000-0.0000i \\ 0.0000 & 3.8594+0.4169i \end{bmatrix}$$

As noted above in relation to the matrix $W_{MS}$, separate $W_{MS_norm1}$ matrices may be used for separate frequencies or frequency bands represented by the mid-side signals $x_M$ and $x_S$. Accordingly, different values may be applied to frequency components of the side-component signal $x_S$.

Figure 7:
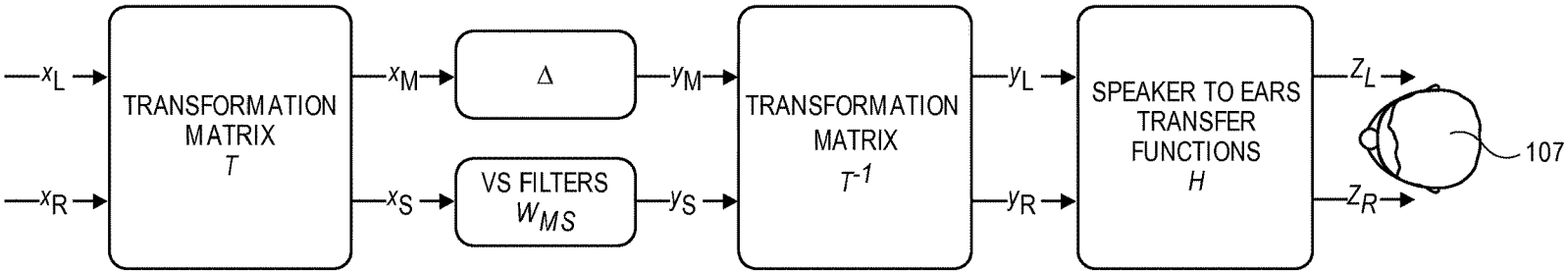
FIG. 7 shows a signal flow diagram for performing crosstalk cancellation and generating virtual sound sources according to another embodiment where a mid-component signal avoids crosstalk cancellation and virtual sound source generation processing.
Figure 8:
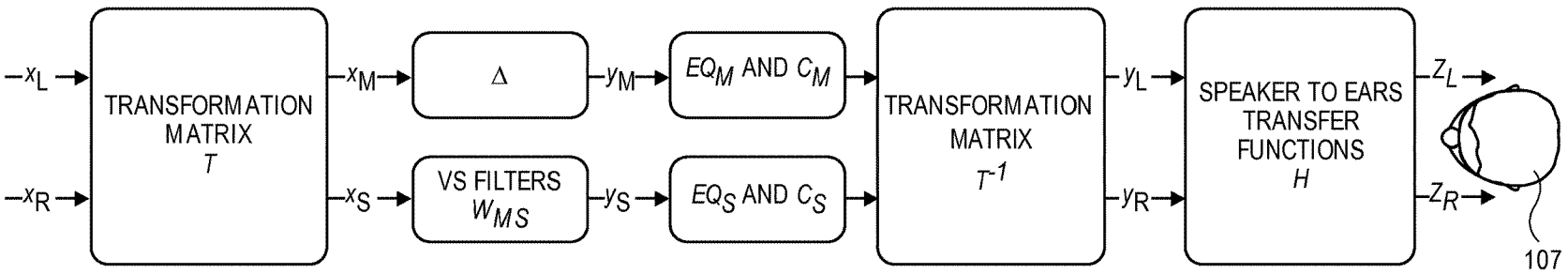
FIG. 8 shows a signal flow diagram for performing crosstalk cancellation and generating virtual sound sources according to another embodiment where equalization and compression are separately applied to mid and side component signals.

By normalizing the mid-component signal $x_M$, the mid-component signal $x_M$ may avoid processing by the matrix $W_{MS_norm1}$. Instead, as shown in FIG. 7, a delay Δ may be introduced to allow the mid-component signal $x_M$ to stay in-sync with the side-component signal $x_S$ while the side-component signal $x_S$ is being processed according to the values in the matrix $W_{MS_norm1}$. Accordingly, even though the side-component signal $x_S$ is processed to produce the virtual sound sources 111, the mid-component signal $x_M$ will not lose synchronization with the side-component signal $x_S$. Further, the system described herein reduces the number of filters traditionally needed to perform crosstalk cancellation on a stereo signal from four to one. In particular, two filters to process each of the left and right signals $x_L$ and $x_R$ to account for D and H, respectively, for a total of four filters has been reduced to a single filter $W_{MS}$ or $W_{MS_norm1}$ In one embodiment, compression and equalization may be independently applied to the separate chains of mid and side components. For example, as shown in FIG. 8, separate equalization and compression blocks may be added to the processing chain. In this embodiment, the equalization $EQ_M$ and compression $C_M$ applied to the mid-component signal $x_M$ may be separate and distinct from the equalization $EQ_S$ and compression $C_S$ applied to the side-component signal $x_S$. Accordingly, the mid-component signal $x_M$ may be separately equalized and compressed in relation to the side-component signal $x_S$. In these embodiments, the equalization $EQ_M$ and $EQ_S$ and compression $C_M$ and $C_S$ factors may reduce the level of the signals $x_M$ and $x_S$, respectively, in one or more frequency bands to reduce the effects of ill-conditioning, such as coloration.

Figure 9A:
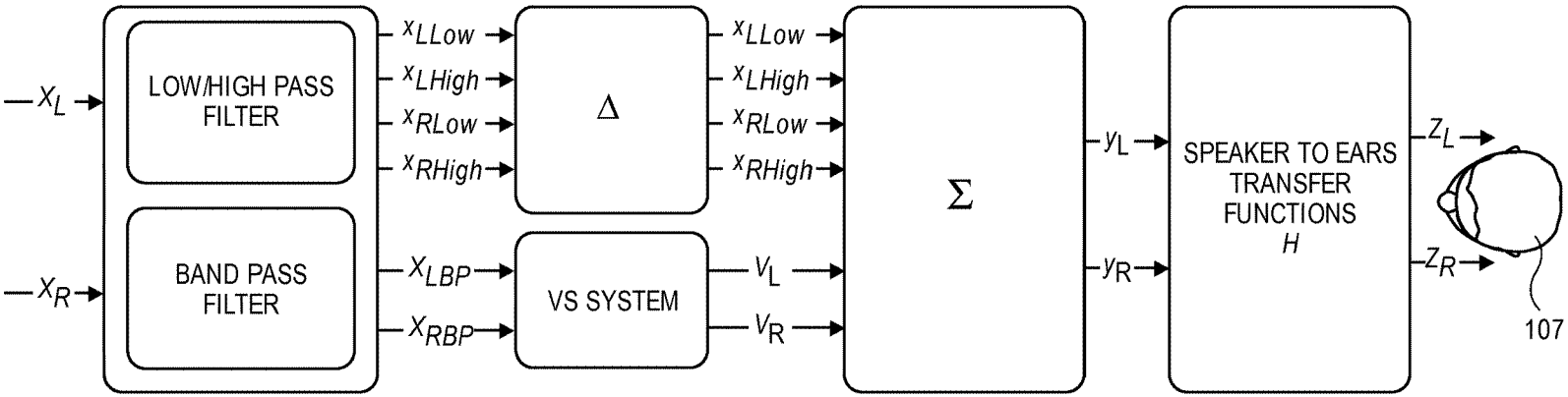
FIG. 9A shows a signal flow diagram for performing crosstalk cancellation and generating virtual sound sources according to another embodiment where frequency bands of input stereo signals are filtered prior to processing.
Figure 9B:
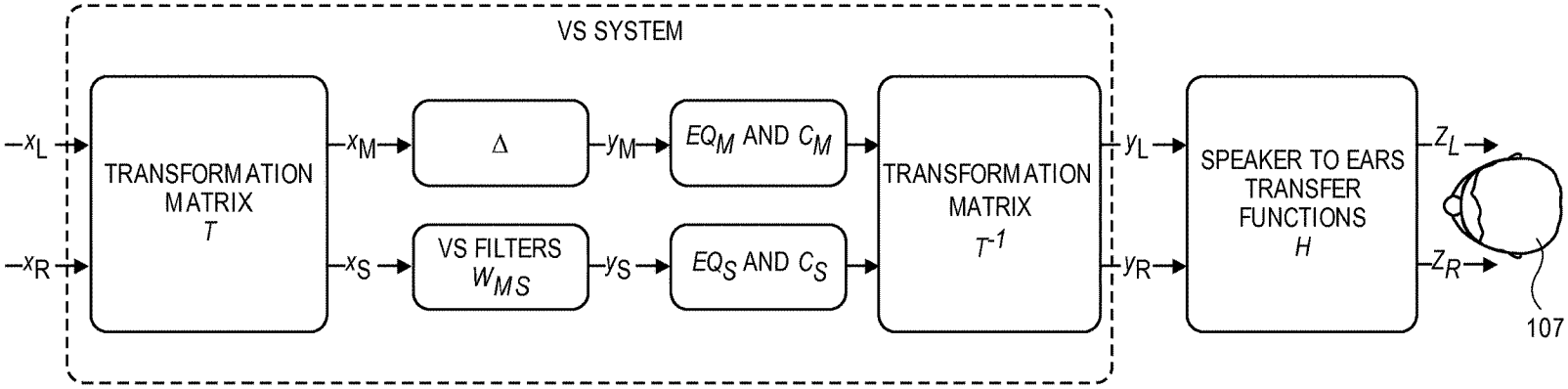
FIG. 9B shows the division of a processing system according to one embodiment.

In some embodiments, ill-conditioning may be a factor of frequency with respect to the original left and right audio signals $x_L$ and $x_R$. In particular, low frequency and high frequency content may suffer from ill-conditioning issues. In these embodiments, low pass, high pass, and band pass filtering may be used to separate each of the signals $x_L$ and $x_R$ by corresponding frequency bands. For example, as shown in FIG. 9A, the signals $x_L$ and $x_R$ may each be passed through a high pass filter, a low pass filter, and a band pass filter. The band pass filter may allow a specified band within each of the signals $x_L$ and $x_R$ to pass through and be processed by the VS system (as defined in FIG. 9B). For example, the band allowed to pass through the band pass filter may be between 750 Hz and 10 kHz; however, in other embodiments other frequency bands may be used. In this embodiment, the low pass filter may have a cutoff frequency equal to the low end of the frequency band allowed to pass through the band pass filter (e.g., the cutoff frequency of the low pass filter may be 750 Hz). Similarly, the high pass filter may have a cutoff frequency equal to the high end of the frequency band allowed to pass through the band pass filter (e.g., the cutoff frequency of the high pass filter may be 10 kHz). As noted above, each of the signals generated by the band pass filter (e.g., the signals $x_{LBP}$ and $x_{RBP}$) may be processed by the VS system as described above. Although the VS system has been defined in relation to the system shown in FIG. 9B and FIG. 8, in other embodiments the VS system may be instead similar or identical to the systems shown in FIGS. 5-7. To ensure that the signals produced by the low pass filter (e.g., the signals $x_{LLow}$ and $x_{RLow}$) and the high pass filter (e.g., the signals $x_{LHigh}$ and $x_{RHigh}$) are in-sync with the signals being processed by the VS system, a delay Δ' may be introduced. The delay Δ' may be distinct from the delay Δ in the VS system.

Following processing and delay, the signals produced by the VS system $v_L$ and $v_R$ may be summed by a summation unit with their delayed/unprocessed counterparts $x_{LLow}$, $x_{RLow}$, $x_{LHigh}$ and $x_{RHigh}$ to produce the signals $y_L$ and $y_R$. These signals $y_L$ and $y_R$ may be played through the loudspeakers 105 to produce the left-right stereo signals $z_L$ and $z_R$, which represent sound respectively heard at the left and right ears of the listener 107. As noted above, by sequestering low and high components of the original signals $x_L$ and $x_R$, the system and method for processing described herein may reduce the effects of ill-conditioning, such as coloration that may be caused by processing problematic frequency bands.

As noted above, the system and method described herein transforms stereo signals into mid and side components $x_M$ and $x_S$ to apply processing to only the side-component $x_S$ and avoid processing the mid-component $x_M$. By avoiding alteration to the mid-component $x_M$, the system and method described herein may eliminate or greatly reduce the effects of ill-conditioning, such as coloration that may be caused by processing the problematic mid-component $x_M$ while still performing crosstalk cancellation and/or generating the virtual sound sources 111.

As explained above, an embodiment of the invention may be an article of manufacture in which a machine-readable medium (such as microelectronic memory) has stored thereon instructions that program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for generating a set of virtual sound sources based on a left audio signal and a right audio signal corresponding to left and right channels for a piece of sound program content, comprising:

transforming the left and right audio signals to a mid-component signal and a side-component signal;

generating a set of filter values for the mid-component signal and the side-component signal, wherein the filter values 1) provide crosstalk cancellation between two speakers and 2) simulate virtual sound sources for the left and right channels of the piece of sound program content;

normalizing the set of filter values to produce normalized filter values, wherein normalizing the set of filter values comprises dividing each non-zero filter value by the filter value corresponding to the mid-component signal such that the normalized filter values that correspond to the mid-component signal are equal to a desired value; and applying the normalized set of filter values to one or more of the mid-component signal and the side-component signal.

2. The method of claim 1, wherein the mid-component signal is the sum of the right and left audio signals and the side-component signal is the difference between the left and right audio signals.

3. The method of claim 1, further comprising:

transforming the resulting signals produced from the application of the set of normalized filter values to the one or more of the mid-component signal and the side-component signal to produce a left filtered stereo audio signal and a right filtered stereo audio signal; and driving the two speakers using the left filtered stereo audio signal and the right filtered stereo audio signal to generate the virtual sound sources.

4. The method of claim 3, further comprising:

band pass filtering the left audio signal using a first cutoff frequency and a second cutoff frequency to produce a band pass left signal, such that the band pass left signal includes frequencies from the left audio signal between the first and second cutoff frequencies; and band pass filtering the right audio signal using the first and second cutoff frequencies to produce a band pass right signal, such that the band pass right signal includes frequencies from the right audio signal between the first and second cutoff frequencies, wherein the band pass left and right signals are transformed to produce the mid-component signal and the side-component signal.

5. The method of claim 4, further comprising:

low pass filtering the left audio signal using the first cutoff frequency to produce a low pass left signal;

low pass filtering the right audio signal using the first cutoff frequency to produce a low pass right signal;

high pass filtering the left audio signal using the second cutoff frequency to produce a high pass left signal;

high pass filtering the right audio signal using the second cutoff frequency to produce a high pass right signal;

combining the low pass left signal and the high pass left signal with the left filtered stereo audio signal; and combining the low pass right signal and the high pass right signal with the right filtered stereo audio signal, wherein the left filtered stereo audio signal after combination with the low pass left signal and the high pass left signal and the right filtered stereo audio signal after combination with the low pass right signal and the high pass right signal are used to drive the two speakers.

6. The method of claim 3, further comprising:

compressing the mid-component signal; and compressing the side-component signal, wherein compression of the mid-component signal is performed separately from compression of the side-component signal.

7. The method of claim 1, wherein the normalized set of filter values are applied to the side-component signal, the method further comprising:

applying a delay to the mid-component signal while the side-component signal is being filtered using the normalized set of filter values such that the mid-component signal remains in sync with the side-component signal as a result of the delay.

8. The method of claim 1 wherein normalizing the set of filter values comprises dividing each non-zero filter value by the filter value corresponding to the mid-component signal such that the normalized filter values corresponding to the mid-component are equal to one.

9. The method of claim 1 further comprising:

equalizing the mid-component signal; and equalizing the side-component signal, wherein equalization of the mid-component signal is performed separately from equalization of the side-component signal.

10. A system for generating a set of virtual sound sources based on a left audio signal and a right audio signal corresponding to left and right channels for a piece of sound program content, comprising:

a first set of filters to transform the left and right audio signals to a mid-component signal and a side-component signal;

a processor to:

generate a set of filter values for the mid-component signal and the side-component signal, wherein the filter values 1) provide crosstalk cancellation between two speakers and 2) simulate virtual sound sources for the left and right channels of the piece of sound program content, and normalize the set of filter values to produce normalized filter values, wherein normalizing the set of filter values comprises dividing each non-zero filter value by the filter value corresponding to the mid-component signal such that the normalized filter values that correspond to the mid-component signal are equal to a desired value; and a second set of filters to apply the normalized set of filter values to one or more of the mid-component signal and the side-component signal.

11. The system of claim 10, wherein the mid-component signal is the sum of the right and left audio signals and the side-component signal is the difference between the left and right audio signals.

12. The system of claim 10, wherein normalizing the set of filter values comprises dividing each non-zero filter value by the filter value corresponding to the mid-component signal such that the normalized filter values corresponding to the mid-component are equal to one.

13. The system of claim 10, further comprising:

a third set of filters to transform the resulting signals produced from the application of the set of filter values to one or more of the mid-component signal and the side-component signal to produce left and right filtered audio signals; and a set of drivers to drive the two speakers using the left and right filtered audio signals to generate the virtual sound sources.

14. The system of claim 13, further comprising:

a band pass filter to 1) filter the left audio signal using a first cutoff frequency and a second cutoff frequency to produce a band pass left signal, such that the band pass left signal includes frequencies from the left audio signal between the first and second cutoff frequencies and 2) filter the right audio signal using the first and second cutoff frequencies to produce a band pass right signal, such that the band pass right signal includes frequencies from the right audio signal between the first and second cutoff frequencies, wherein the band pass left and right signals are transformed by the first set of filters to produce the mid-component signal and the side-component signal.

15. The system of claim 14, further comprising:

a low pass filter to filter 1) the left audio signal using the first cutoff frequency to produce a low pass left signal and 2) the right audio signal using the first cutoff frequency to produce a low pass right signal;

a high pass filter to filter 1) the left audio signal using the second cutoff frequency to produce a high pass left signal and 2) the right audio signal using the second cutoff frequency to produce a high pass right signal;

a summation unit to combine 1) the low pass left signal and the high pass left signal to the left filtered audio signal and 2) the low pass right signal and the high pass right signal to the right filtered audio signal, wherein the left filtered audio signal after combination with the low pass left signal and the high pass left signal and the right filtered audio signal after combination with the low pass right signal and the high pass right signal are used to drive the two speakers.

16. The system of claim 12, wherein first set of filters, the second set of filters, and the third set of filters are finite impulse response (FIR) filters.

17. An article of manufacture for generating a set of virtual sound sources based on a left audio signal and a right audio signal corresponding to left and right channels for a piece of sound program content, comprising:

a non-transitory machine-readable storage medium that stores instructions which, when executed by a processor in a computing device, transform the left and right audio signals to a mid-component signal and a side-component signal;

generate a set of filter values for the mid-component signal and the side-component signal, wherein the filter values 1) provide crosstalk cancellation between two speakers and 2) simulate virtual sound sources for the left and right channels of the piece of sound program content;

normalize the set of filter values to produce normalized filter values, wherein normalizing the set of filter values comprises dividing each non-zero filter value by the filter value corresponding to the mid-component signal such that the normalized filter values that correspond to the mid-component signal are equal to a desired value; and apply the normalized set of filter values to one or more of the mid-component signal and the side-component signal.

18. The article of manufacture of claim 17, wherein the mid-component signal is the sum of the right and left audio signals and the side-component signal is the difference between the left and right audio signals.

19. The article of manufacture of claim 17, wherein the non-transitory machine-readable storage medium stores further instructions which when executed by the processor:

transform the resulting signals produced from the application of the set of filter values to one or more of the mid-component signal and the side-component signal to produce left and right filtered audio signals; and drive the two speakers using the left and right filtered audio signals to generate the virtual sound sources.

20. The article of manufacture of claim 17, wherein normalizing the set of filter values comprises dividing each non-zero filter value by the filter value corresponding to the mid-component signal such that the normalized filter values corresponding to the mid-component are equal to one.

21. The article of manufacture of claim 20, wherein the non-transitory machine-readable storage medium stores further instructions which when executed by the processor:

equalize the mid-component signal; and equalize the side-component signal, wherein equalization of the mid-component signal is performed separately from equalization of the side-component signal.

22. The article of manufacture of claim 20, wherein the non-transitory machine-readable storage medium stores further instructions which when executed by the processor:

compress the mid-component signal; and compress the side-component signal, wherein compression of the mid-component signal is performed separately from compression of the side-component signal.

* * * * *